US005906366A

United States Patent [19]

Chang

[11] Patent Number: 5,906,366

[45] Date of Patent: May 25, 1999

[54] CARD OUTLET CLEARANCE ADJUSTING DEVICE FOR CARD STACKING MACHINES

[75] Inventor: Yuan Fong Chang, Taipei, Taiwan

[73] Assignee: Gamemax Corporation, Taipei, Taiwan

[21] Appl. No.: 09/044,096

[22] Filed: Mar. 19, 1998

[51] Int. Cl.[6] ..... B65H 3/52; B65H 1/08; B65H 59/00

[52] U.S. Cl. ..... 271/124; 221/231; 414/797.7

[58] Field of Search ..... 221/231, 255; 271/121, 124, 126, 134; 414/797.6, 797.7, 797.8, 797.9

[56] References Cited

U.S. PATENT DOCUMENTS

| | | | |
|---|---|---|---|
| 4,961,566 | 10/1990 | Labombarde | 271/124 X |
| 5,417,412 | 5/1995 | Vegeais et al. | 271/121 X |
| 5,642,877 | 7/1997 | Green | 271/124 X |

*Primary Examiner*—William E. Terrell
*Assistant Examiner*—Kenneth W. Bower
*Attorney, Agent, or Firm*—Smith, Gambrell & Russell, LLP; Beveridge, DeGrandi, Weilacher & Young Intellectual Property Group

[57] ABSTRACT

A card output clearance adjusting device for card stacking machines, in particular a clearance adjusting device adapted for telephone cards and the like, including a receiving body, a conveyance device, and a press plate. The receiving body has a main frame and a support seat. The components of the conveyance device are disposed between the main frame and the support seat. The adjusting device has a securing plate formed by directly bending an upper portion of the main frame at an angle of 90 degrees, and a movable adjusting plate at a lower portion thereof The movable adjusting plate has guide track plates at both sides thereof movably inserted into corresponding guide tracks at both sides of the support seat. The upper surface of the movable adjusting plate is provided with four guide posts fitted with stop springs respectively. An upper end portion of each guide post extends into a corresponding hollow guide hole of the securing seat. An adjusting rotary knob is inserted via a through hole of the securing seat into a nut of the movable adjusting plate. By turning the adjusting rotary knob, micro-adjustment of a clearance between an inclined surface at the lower portion of the movable adjusting plate and a bottom plate of the support seat may be allowed to achieve optimal card output.

1 Claim, 5 Drawing Sheets

CARD OUTLET CLEARANCE ADJUSTING DEVICE FOR CARD STACKING MACHINES

BACKGROUND OF THE INVENTION (a) Field of the Invention:

The present invention relates generally to a card outlet adjusting device for card stacking machines, and more particularly to an adjusting device in which a securing plate extended from an upper portion of a main frame of a receiving body and a movable adjusting plate movably provided at a front end of a support seat are provided and four guide posts fitted with stop springs and an adjusting rotary knob disposed between the securing plate and the movable adjusting plate are utilized to achieve precision adjustment of the card outlet clearance.

(b) Description of the Prior Art:

Telephone card vending machines are common today. Such vending machines may also be adapted to sell other cards. However, although the thickness of cards is quite uniform, minute difference in thickness may cause blocking or hinder the smooth discharge of cards from the vending machines. A card outlet adjusting device allowing micro-adjustment of the card outlet and of a simple construction is therefore desirable.

The inventor of the present invention has found that little difference in the thickness of cards will directly affect the smooth discharge of cards from card vending machines and conceived the present invention to solve this problem by providing a card outlet adjusting device after repeated experimentation.

SUMMARY OF THE INVENTION

A primary object of the present invention is to provide a card outlet clearance adjusting device for card stacking machines, in which four guide posts fitted with stop springs respectively are disposed between a securing seat and a movable adjusting plate for balancing and positioning purposes. An adjusting rotary knob is provided to allow up-and-down adjustment of the movable adjusting plate so that micro-adjustment of a clearance between an inclined surface at the lower portion of the movable adjusting plate and a bottom plate of a support seat. The adjusting device is simple in construction and inexpensive to manufacture.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENT

Figure 1:
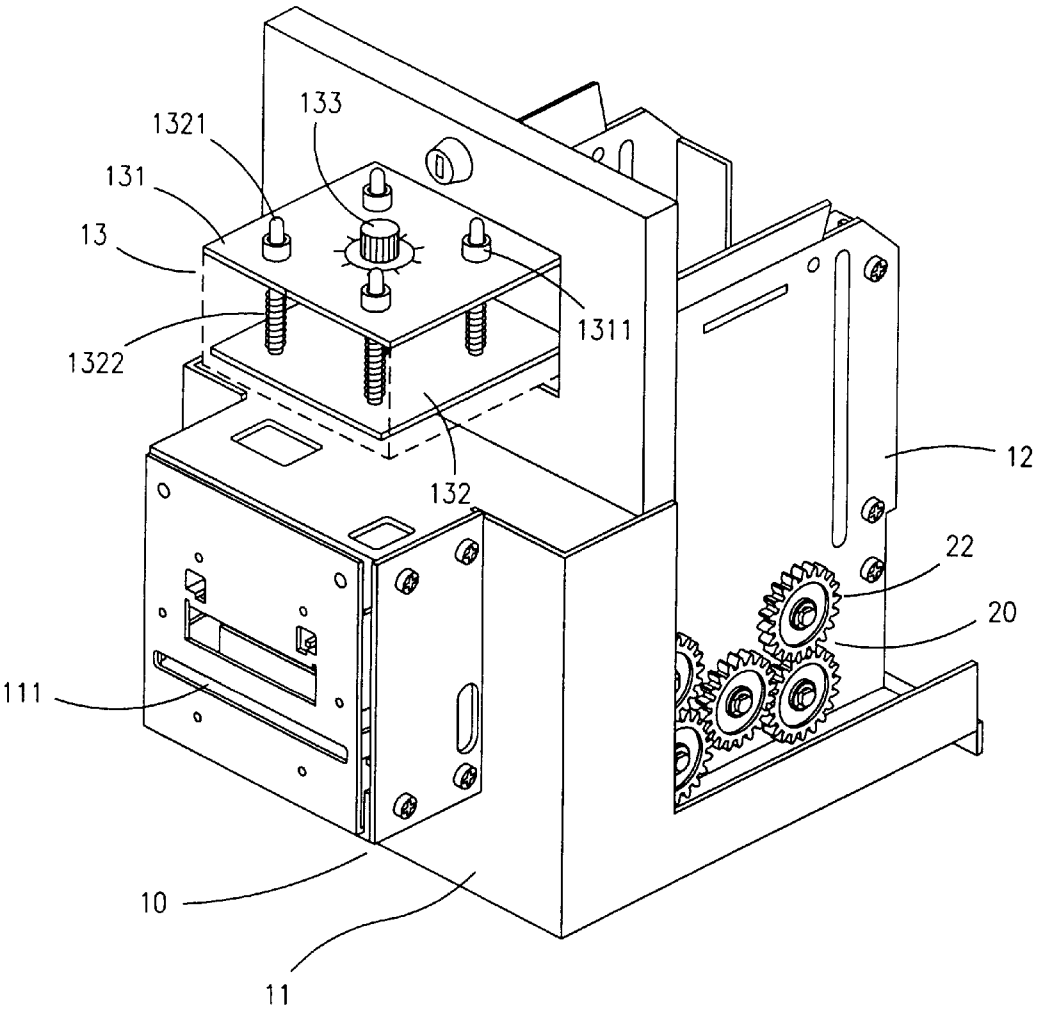
FIG. 1 is a perspective view of the present invention.
Figure 2:
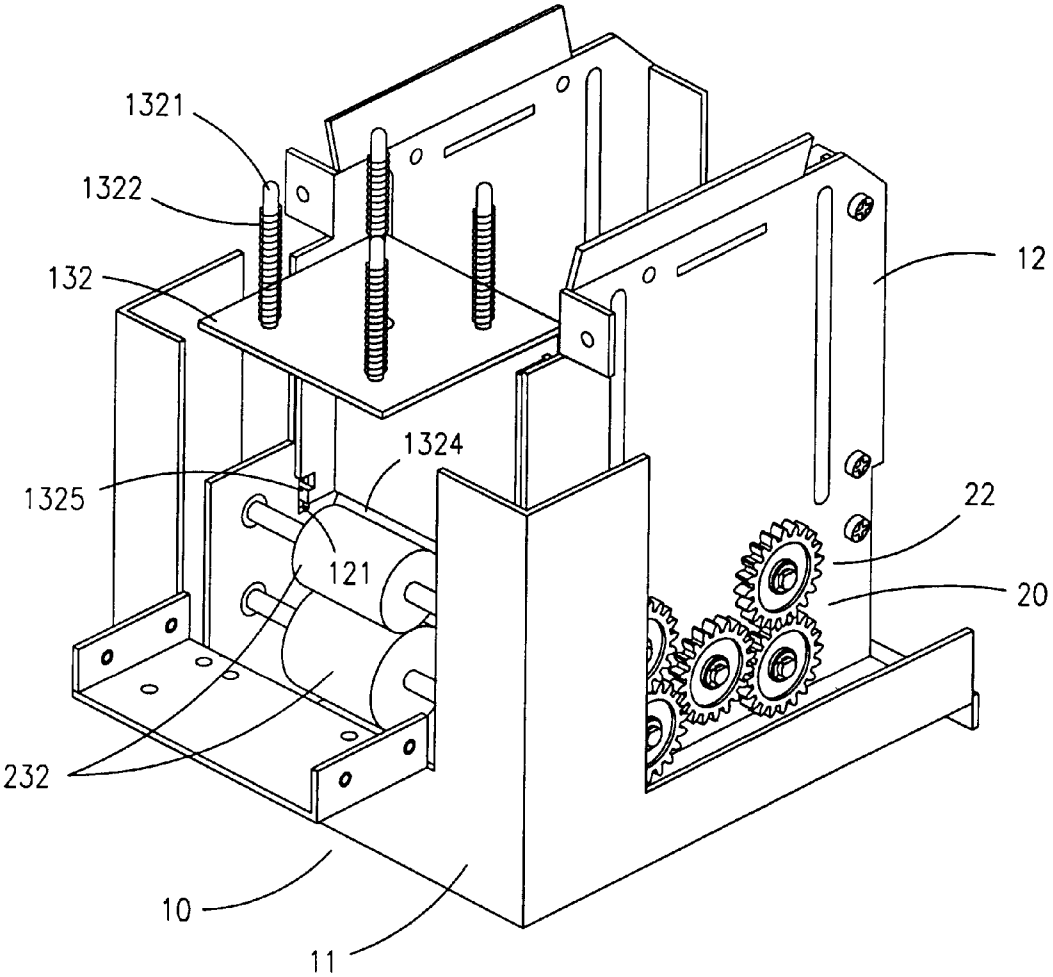
FIG. 2 is a schematic perspective view of an adjusting device in a receiving body of the present invention.
Figure 3:
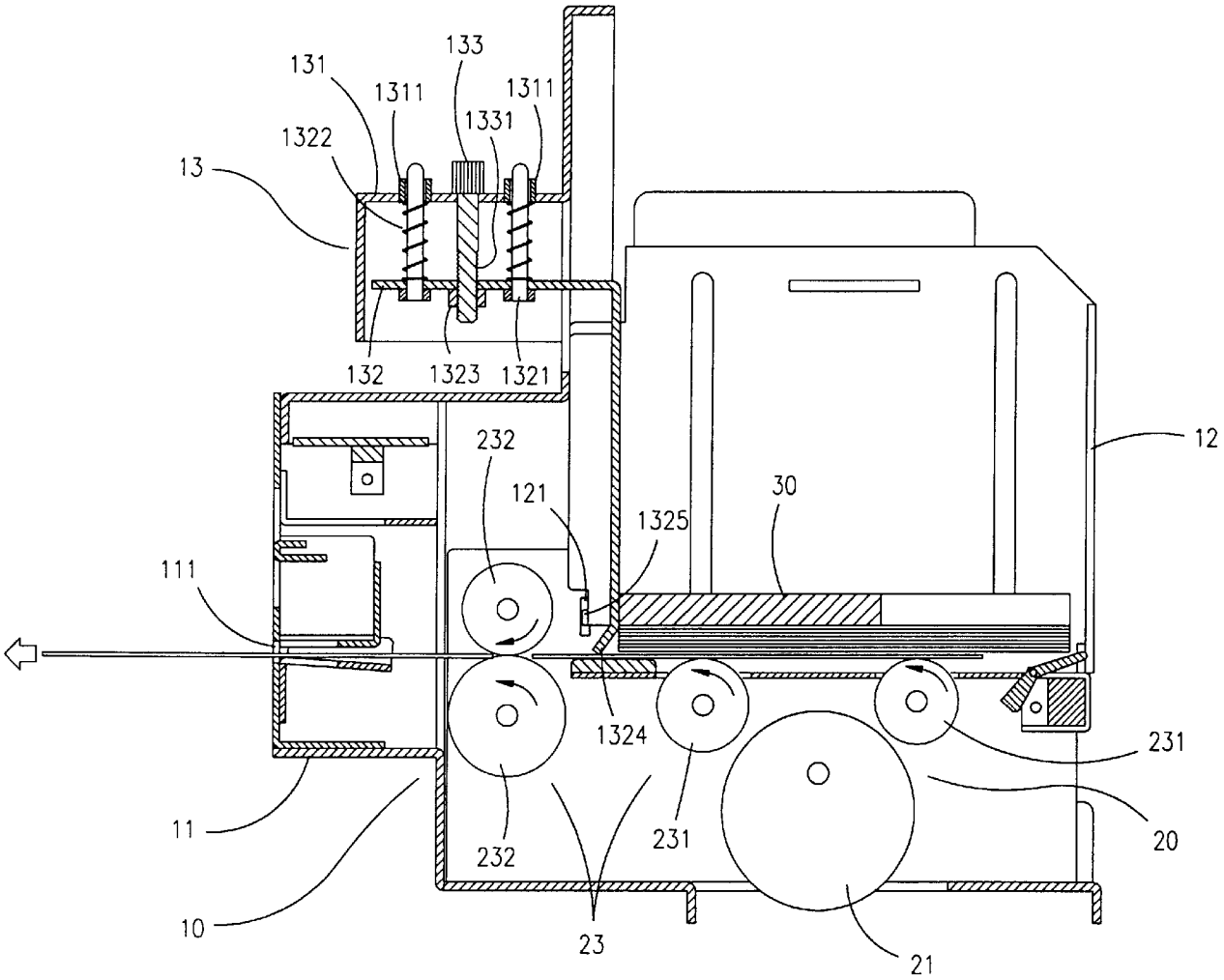
FIG. 3 is a sectional side view illustrating operation of the present invention.
Figure 4:
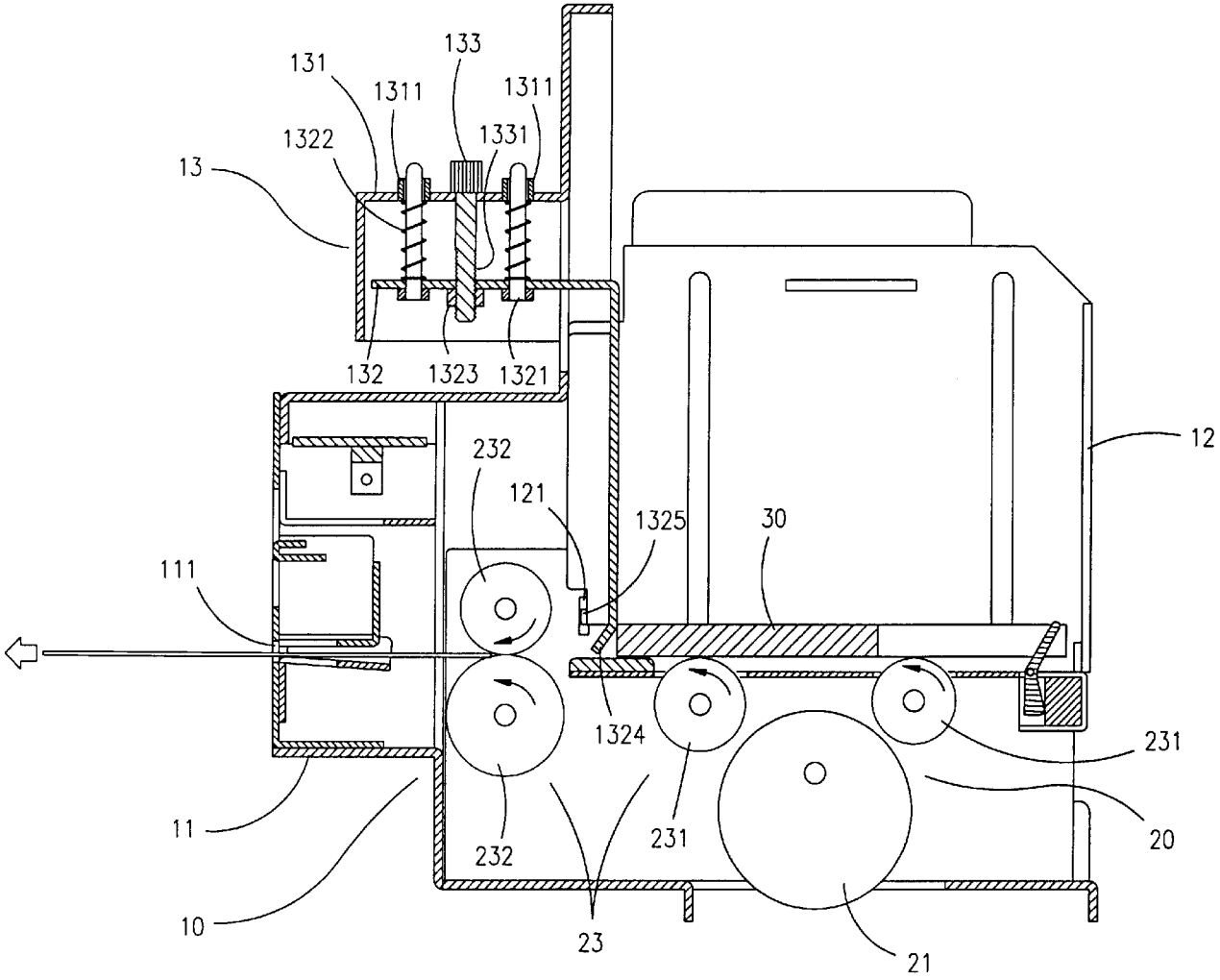
FIG. 4 is a schematic sectional side view of the present invention after conveyance of cards.

With reference to FIGS. 1 and 2, the present invention comprises a receiving body 10 having an L-shaped main frame 11, and a support seat 12 and an adjusting device 13 fixedly provided on an upper side of the receiving body 10. Referring to FIG. 3, the components of a conveyance device 20 are disposed between the main frame 11 and the support seat 12. When cards are placed inside the support seat 12, a press plate is used to exert a downward force thereon to increase the friction between two parallel output rollers and the cards. The structure of the present invention is described in detail hereinafter.

The receiving body 10 includes the above-mentioned main frame 11, the support seat 12 and the adjusting device 13. The front end of the main frame 11 is provided with a card outlet 111. The adjusting device 13 has a securing seat 131 fixedly provided on a faceplate above the card outlet 111. The support seat 12 is fixedly provided on a rear side of the main frame 11. The support seat has a pair of symmetrical guide tracks 121 disposed at the front ends of the lateral plates. The adjusting device 3 has a movable adjusting plate 132 having two guide track plates 1325 respectively inserted into the guide tracks 121 to slidably displace therein. The movable adjusting plate 132 has a planar upper surface to which four guide posts 1321 are welded. Each guide post 132 is fitted with a stop spring 1322 and has an upper portion fitting into a corresponding hollow guide hole 1311 of the securing seat 131. An adjusting rotary knob 133 is passed downwardly through a through hole 1312 of the securing seat 131 such that a threaded portion 1331 thereof is locked into a nut 1323 of the movable adjusting plate 132.

The conveyance device 20 includes a motor 21, a gear set 22, a roller set 23 and a switch 24. The motor 21 drives the gear set 22 and the roller set 23. The roller set 23 includes conveyor rollers 231 adapted to output cards to a clearance between the two rollers 232 disposed at the front end of the support seat 12. After outputting of the cards is accomplished, the switch 24 may be used to stop the motor 21. As this arrangement is not a technical feature of the present invention, it will not be described in detail herein.

Figure 5:
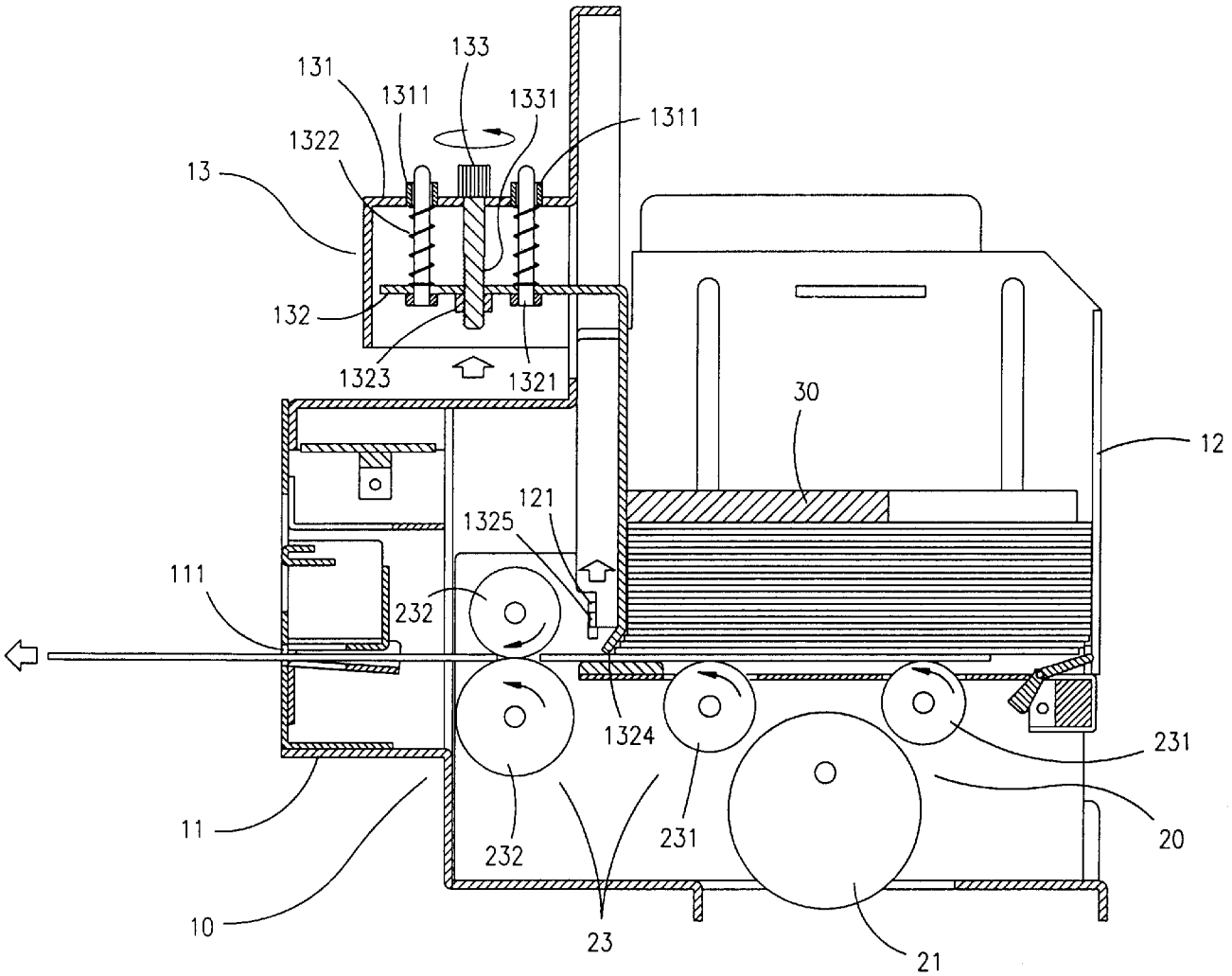
FIG. 5 is a schematic sectional side view illustrating the operation of the present invention after adjustment of the clearance.

Referring to FIGS. 2, 3, and 5, when it is desirable to adjust the clearance between the output rollers 232, the adjusting rotary knob 133 of the adjusting device 13 is turned so that the threaded portion at the lower end thereof rotarily displace upwardly and downwardly in the nut 1323 secured on the movable adjusting plate 132. At this point, the four guide posts 1321 welded to the movable adjusting plate 132 will utilize the stop springs thereon to balance the surround pressure and cause the upper portions of the guide posts 1321 to displace along the hollow guide holes 1311 of the securing seat 131 according to the magnitude of force of rotation of the adjusting rotary knob 133. Besides, the guide track plates 1325 at both sides of the lower portion of the movable adjusting plate 132 are caused to displace in the guide tracks 121 of the support seat 12. At this point, a desirable precise clearance is formed between an inclined surface 1324 of the movable adjusting plate 132 and a bottom plate of the support seat 12. It can therefore be appreciated that the present invention is simple in construction and economical to manufacture to achieve precise adjustment of the card output clearance.

Although the present invention has been illustrated and described with reference to the preferred embodiment thereof, it should be understood that it is in no way limited to the details of such embodiment but is capable of numerous modifications within the scope of the appended claims.

What is claimed is:

1. A card output clearance adjusting device for card stacking machines, comprising a receiving body, a conveyance device, and a press plate, said receiving body including a main frame and a support seat, having a bottom plate the components of said conveyance device being disposed between said main frame and said support seat, wherein said adjusting device is disposed at an upper portion of said receiving body and includes a securing seat formed by directly bending an upper portion of said main frame at an angle of 90 degrees, and a movable adjusting plate at a lower portion thereof, said movable adjusting plate having two guide track plates at both sides of a lower portion thereof which are movably inserted into corresponding guide tracks of two lateral side plates of said support seat and positioned therein, said movable adjusting plate further having an inclined surface at the lower portion thereof, and having four guide posts fixedly provided on an upper surface thereof, each of said guide posts being fitted with a stop spring and having an upper end portion extending into a corresponding hollow guide hole of securing seat, an adjusting rotary knob being inserted into a through hole of said securing hole such that a threaded portion at a lower end thereof is screwably locked in a nut of said movable adjusting plate, whereby when said adjusting rotary knob of said adjusting device is turned, said threaded portion thereof will displace upwardly and downwardly in said nut secured on said movable adjusting plate, with said four guide posts on said movable adjusting plate achieving balance via said stop springs fitted thereon, said upper end portions of said guide posts being caused to displace upwardly and downwardly in said hollow guide holes of said securing seat according to the adjusted magnitude of force of said adjusting rotary knob, said guide track plates at both sides of the lower portion of said movable adjusting plate simultaneously displacing in said guide tracks of said support seat such that, at this point, said inclined surface at the lower portion of said movable adjusting plate and said bottom plate of said support seat forms a precise adjusted clearance for card output.

* * * * *